United States Patent [19]

Nishida et al.

[11] 3,980,465

[45] Sept. 14, 1976

[54] PROCESS FOR PRODUCING IRON ORE OXIDIZED PELLETS FROM MAGNETITE CONCENTRATE

[75] Inventors: Reijiro Nishida; Kunio Takeda; Dentaro Kaneko, all of Kobe; Kunio Uchida, Akashi, all of Japan

[73] Assignee: Kobe Steel Ltd., Kobe, Japan

[22] Filed: Oct. 2, 1974

[21] Appl. No.: 511,371

[30] Foreign Application Priority Data

Oct. 2, 1973 Japan ..... 48-110762

[52] U.S. Cl. ..... 75/3; 75/41

[51] Int. Cl.[2] ..... C22B 1/24

[58] Field of Search ..... 75/3–5, 75/41

[56] References Cited

UNITED STATES PATENTS

| | | | |
|---|---|---|---|
| 2,931,717 | 4/1960 | Lee | 75/3 |
| 3,189,436 | 6/1965 | Bunstlein | 75/3 |
| 3,264,091 | 8/1966 | Ban | 75/3 |
| 3,316,081 | 4/1967 | Bratton | 75/3 |

*Primary Examiner*—Peter D. Rosenberg

*Attorney, Agent, or Firm*—Oblon, Fisher, Spivak, McClelland & Maier

[57] ABSTRACT

Iron-ore oxidized pellets are produced from magnetite concentrate by the addition to the magnetite concentrate of at least one calcium compound selected from the group consisting of slaked lime, quicklime and limestone, to a basicity of 1 to 5, granulating the mixture thus prepared, drying the same, preheating the same at a temperature of from 1000° to 1150°C for 3 to 10 minutes, and thereafter firing the same.

6 Claims, 9 Drawing Figures

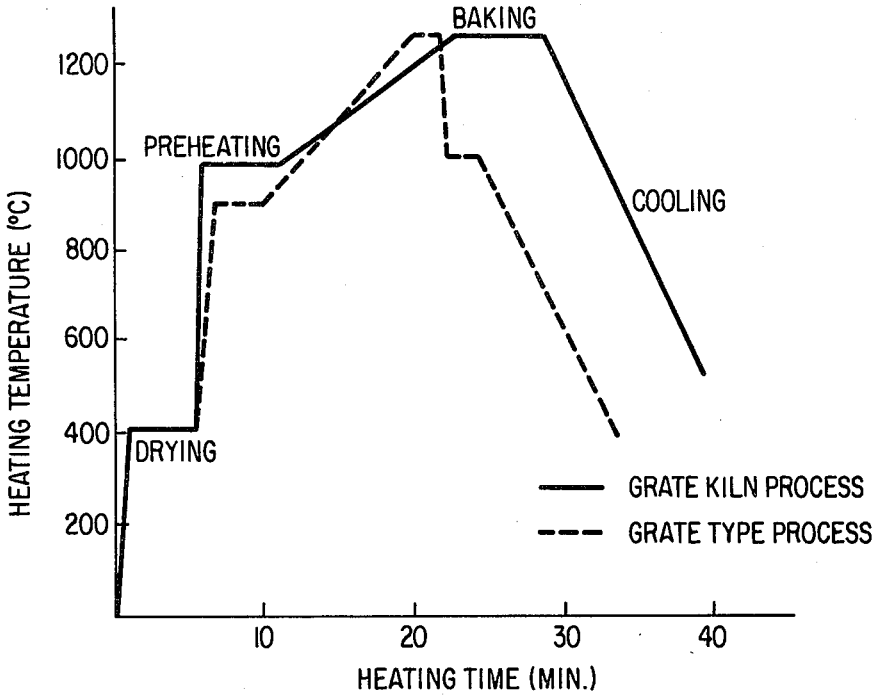
FIG. 1 TIME vs. TEMPERATURE CURVES IN PELLET BAKING PROCESS
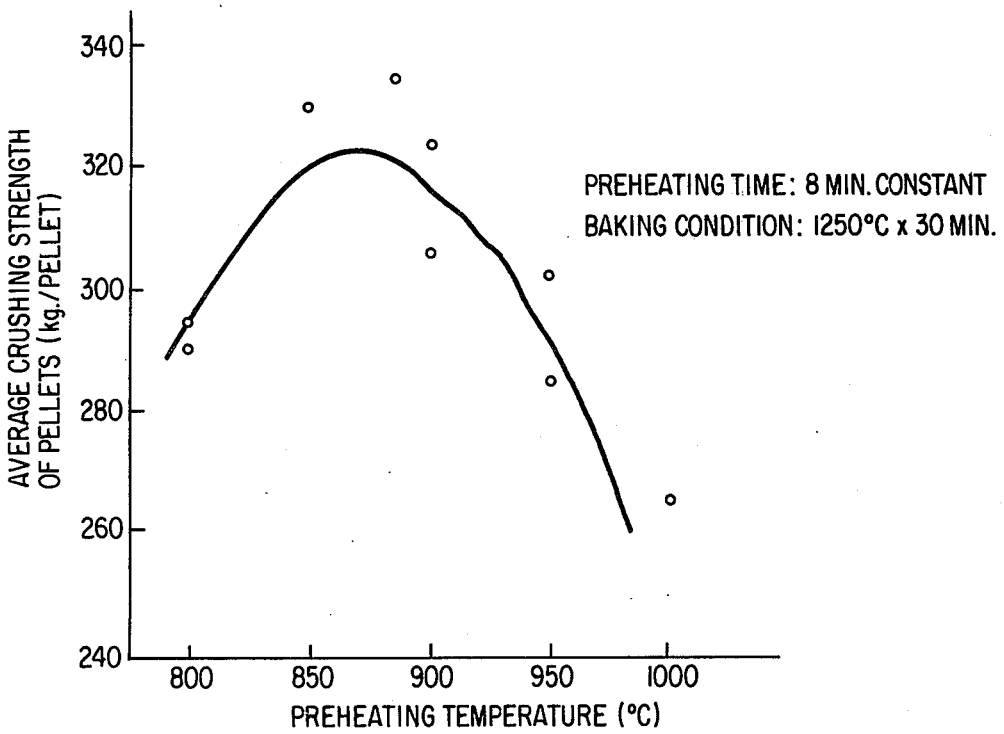
FIG. 2 RELATIONSHIP BETWEEN PREHEATING TEMPERATURE AND CRUSHING STRENGTH OF BAKED PELLETS

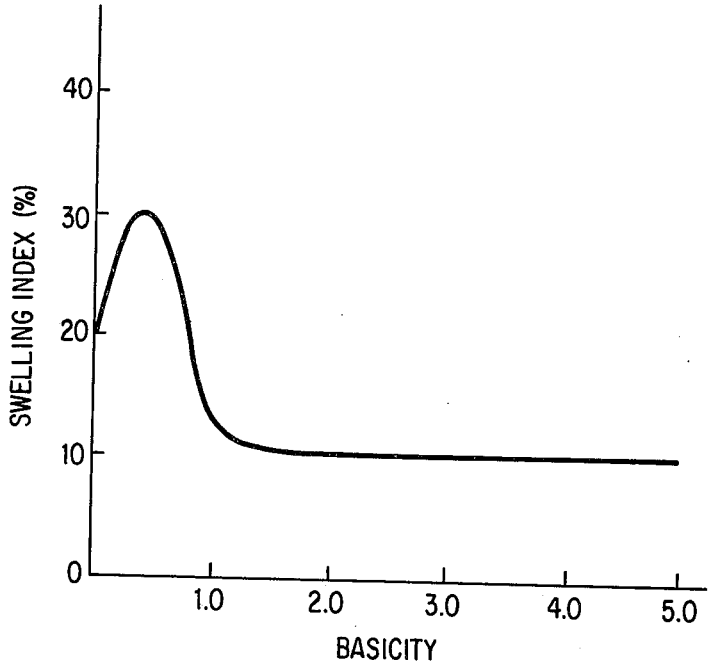
FIG.4 RELATIONSHIP BETWEEN THE BASICITY AND THE SWELLING INDEX OF PELLETS PRODUCED FROM MAGNETITE ORE

PROCESS FOR PRODUCING IRON ORE OXIDIZED PELLETS FROM MAGNETITE CONCENTRATE

BACKGROUND OF THE INVENTION

1. Field of the Invention

This invention relates to a process for producing iron-ore oxidized pellets from magnetite concentrate.

2. Description of the Prior Art

It is known that the production of iron can be increased by using the so-called pelletizing technique, i.e., a process for producing pellets from iron-ore powder, for use in blast furnaces. In general, magnetite or mixtures containing magnetite will comprise over 50% of the ore used for this purpose.

Various iron-ore pellet heating and firing processes are known including the use of grate kilns, travelling grates, shaft furnaces, and circular grates. The former two are the most widely accepted at the present time. FIG. 1 shows the usual heating cycle patterns used in the production of pellets from the magnetite concentrate when using the grate kiln or grate type process. In the ordinary grate kiln type process, water and a suitable amount of a binder are first added to the starting concentrate, then the concentrate is granulated in a granulator to a grain size of 8 to 20 mm in diameter. The granules are then placed into a grate kiln for drying, and preliminary firing at a temperature of about 1000°C (This preliminary firing will be referred to as "preheating" hereinafter.). The granules are then fired at a higher temperature to obtain hardened pellet products. The reason for using the preheating process is that magnetite contained in the starting material is oxidized according to the chemical reaction of $4Fe_3O_4 + O_2 \rightarrow 6Fe_2O_3$ with the accompanying formation of hematite bonds which accelerate the induration of the pellets in the subsequent firing process. If the indurating process proceeds in the condition such that magnetite is not sufficiently oxidized, the internal structures of the fired pellets will be non-uniform. The hematite and magnetite will be mixed, which will result in a reduced pellet crush strength and attendant impaired qualities.

The oxidation of magnetite pellets are affected by temperature, flow rate of gas, oxygen concentration in gas, grain size of material, porosity of the pellets, and the like. In general, the oxidation reaction starts at a temperature of 400°C, and the higher the temperature, the more rapidly the oxidation reaction will proceed. However, if the oxidation reaction is carried out too rapidly, then abrupt oxidation can occur only on the outer peripheral surfaces of the pellets, resulting in a sintered and highly dense pellet surface structure. This dense and hard surface will prevent gas from diffusing into the interior of the pellets, resulting in insufficient oxidation. In such a case, the pellet structure will consist of a dense, outer peripheral layer of hematite bonds, and an inner layer having residual magnetite therein. In other words, a so-called double structure will result, which further often exhibits concentrically extending cracks along the boundaries of the inner and outer layers. The pellets of such a double or concentric structure will be characterized by reduced crush strength, as well as poor reduction characteristics.

SUMMARY OF THE INVENTION

Accordingly, it is one object of the present invention to provide a process for producing iron-ore oxidized pellets from iron ore which contains predominantly magnetite, thereby obtaining pellets which are free of concentric cracks therein.

It is another object of the present invention to provide a process for producing pellets in an efficient manner by reducing the amount of time required for the aforesaid pellet producing process.

It is still another object of the present invention to provide a process for producing iron-ore oxidized pellets of a magnetite base and of a high quality in an efficient manner.

These and other objects and features of the present invention are readily attained according to the first aspect of the present invention, by a process for producing iron-ore oxidized pellets of a magnetite base, which process comprises the steps of adding to magnetite concentrate at least one calcium compound selected from the group of slaked lime, quicklime, and lime stone, to a basicity of 1 to 5, granulating the mixture thus prepared, drying the same, preheating the same at a temperature of 1000° to 1150°C for 3 to 10 minutes, and firing the same.

According to one preferred embodiment of the present invention, the iron-ore oxidized pellets of a magnetite base are produced in which the aforesaid preheating is carried out at a temperature of 1050° to 1100°C for 4 to 6 minutes.

In a still more preferred embodiment of the present invention, iron-ore oxidized pellets of a magnetite base are produced, in which slaked lime is used as the calcium compound which is mixed with the magnetite base iron concentrate to a basicity of 1 to 2, followed by granulation, drying, preheating at a temperature of 1050° to 1100°C for 4 to 6 minutes and firing.

BRIEF DESCRIPTION OF THE DRAWINGS

FIG. 1 is a graph showing the relationship between the time and the temperature in a conventional pellet heating and firing process;

FIG. 2 is a graph showing the relationship between the preheating temperature used for the production of pellets from magnetite ore and the crushing strength of the pellets produced or fired;

FIG. 4 is a graph showing the relationship between the basicity and the swelling index of pellets produced from magnetite concentrate.

DETAILED DESCRIPTION OF PREFERRED EMBODIMENTS

FIG. 2 shows the relationship between the preheating temperature and the crushing strength of fired pellets produced from a magnetite concentrate obtained from Africa. As can be seen from that graph, too low a preheating temperature will require a longer oxidizing time, while too high a preheating temperature will result in the formation of a non-uniform pellet structure for the reason described earlier, with an accompanying reduction in the strength of the fired pellets. It is imperative for the production of magnetite pellets to select an optimum preheating temperature so as to insure the desired degree of oxidation in the interior of pellets.

Table 1 shows the influence of preheating conditions on the properties of the pellets produced from the same magnetite concentrate. As is clear from Table 1, pellets (C) which have been subjected to a long preheating period, but at a temperature of as low as 900°C, will exhibit superior crush strength and strength after reduction, as compared with samples (A), (B), which had been preheated for only a short time at a high temperature, or at a relatively low temperature for a long period of time.

Figure 3A:
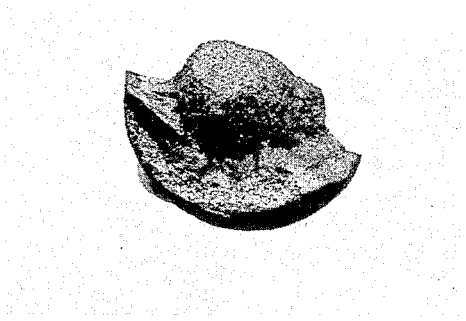
FIGS. 3*a* and *b* are photographs depicting the cross-sectional structures of pellets presenting the influence of the preheating conditions on pellets produced from magnetite concentrate.
Figure 3B:
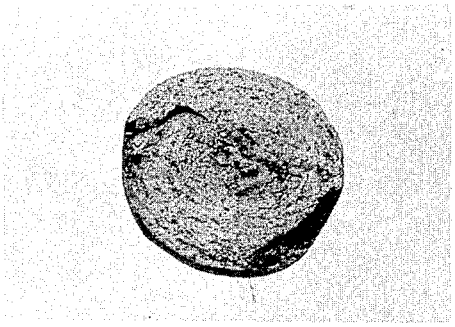
FIGS. 3*c* and *d* are photographs depicting the cross-sectional structure of pellets produced from magnetite concentrate, with bentonite being added thereto, as well as the cross-sectional structure of pellets produced according to the present invention, with slaked lime being added thereto.
FIGS. 3*e* and *f* are photographs depicting the appearances of pellets after reduction, which pellets have been produced, with slaked lime being added to the magnetite concentrate so as to give a basicity of below 1, as well as the appearance of pellets after reduction, which pellets have been produced according to the present invention, with slaked lime being added to magnetite concentrate so as to give the basicity of over 1.
Figure 3C:
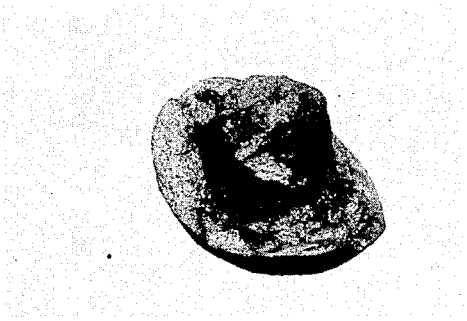
Figure 3D:
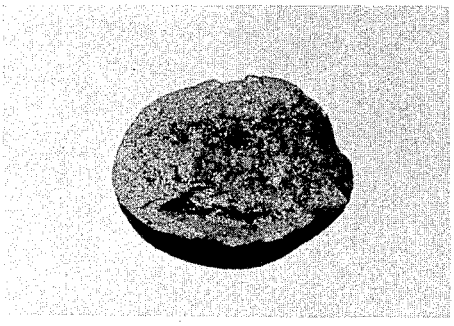
Figure 3E:
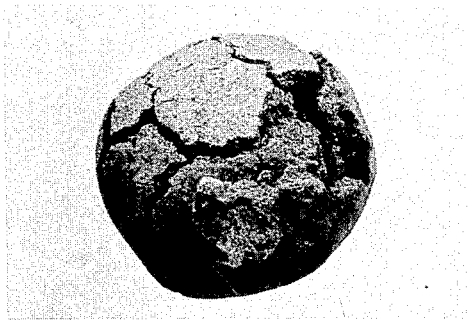
Figure 3F:
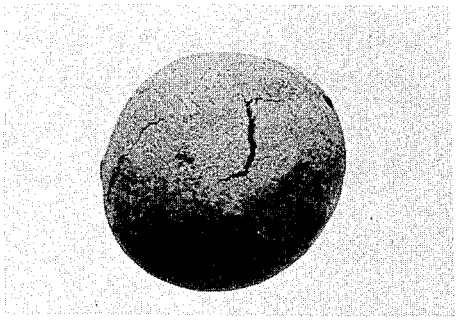

The photographs depicting the cross-sectional structure of pellets produced in such a case are shown in FIGS. 3*a* and *b*. FIG. 3(*a*) depicts pellets which have been preheated at a temperature of 1000°C for 8 minutes, i.e., the pellets (B) shown in Table 1, and FIG. 3(*b*) depicts pellets (C), which have been preheated at a temperature of 900°C for 8 minutes, respectively. As can be seen, the pellets (C) exhibit uniform cross-sectional structure, with the interior of the pellets being sufficiently oxidized, whereas pellets (B) show evidence of rapid oxidation having occured on the outer peripheral surfaces, and evidence of having undergone a sintering reaction, thereby exhibiting a dense outer shell structure, i.e., a so-called double concentric structure. This causes hair cracks along the boundary between the outer shell portion and the inner portion or core of a pellet. Cracks thus developed often will lead to larger cracks in the pellet.

TABLE 1

| | A | B | C |
|---|---|---|---|
| Preheating condition | 1000°C×5 min | 1000°C×8 min | 900°C×8 min |
| Firing condition | 1250°C×30 min | the same as left | the same as left |
| Crush strength kg/P of pellets produced | 238 | 266 | 301 |
| JIS percent reduction | — | 77.9 | 77.2 |
| Strength after reduction | — | 39.8 | 43.2 |

By effectively preventing such a double pellet structure by the use of high temperature preheating, high quality pellets can be produced with real productivity savings in terms of heating time. In addition, in a grate kiln process, kiln exhaust gas may be utilized, thus achieving further industrial advantages. In the present invention, calcium compounds are used, such as slaked lime ($Ca(OH)_2$), quicklime (CaO) and/or limestone ($CaCO_3$). Slaked lime powder is preferred. The calcium compound(s) are added to the magnetite concentrate powder to a basicity of 1 to 5, and the mixture thus prepared is granulated. The granulated mixture is dried at a temperature of 300° to 450°C for 4 to 10 minutes, preheated at a temperature of 1000° to 1150°C for 3 to 10 minutes and fired at a temperature of 1200° to 1350°C. More preferably, the aforesaid preheating is carried out at a temperature of 1050° to 1100°C for 4 to 6 minutes.

Now, description will be given in more detail with reference to the discoveries and considerations made by the inventors. It was found in the course of the tests and production of pellets from magnetite concentrate, that the addition of calcium compounds, particularly slaked calcium ($Ca(OH)_2$) to the starting concentrate may effectively prevent sintering and increase the density of the outer peripheral layers of pellets. This is believed to be a result of rapid oxidation at the time of preheating, which results in the formation of a double structure.

More particularly, decomposition of slaked lime ($Ca(OH)_2$) occurs at a temperature of 400° to 500°C:

$$Ca(OH)_2 \rightarrow CaO + H_2O \text{ -15,930 Kcal/Kmol.}$$

Quicklime (CaO) will exhibit increased activity after drying, and will combine with iron oxides at a given temperature to produce a solid solution as shown by the schematic:

$$CaO + Fe_2O_3 \rightarrow CaO \cdot Fe_2O_3.$$

In practice, the decomposition reaction of the slaked lime ($Ca(OH)_2$) will occur at the terminating phase of the drying step, or in the initial phase of the preheating step. The evaporation and endothermic reaction with moisture contained in the pellets will moderate and suppress the abrupt oxidizing reaction of the magnetite at the time of the high temperature preheating, thereby effectively preventing the formation of a dense outer peripheral layer in the initial stage. The pellets will be porous due to dehydration which results from the indiffusion of gases, thus producing good diffusibility of gases into the pellets in the starting phase of the preheating and firing steps. This results in an enhanced but uniform oxidizing reaction.

If the calcium compound added is quicklime (CaO), the quicklime will be converted to slaked lime due to the moisture added to the starting ore powder prior to granulation, so that the identical results may be achieved.

Similar results will occur from the use of limestone and other calcium compounds. However, for most practical applications, it will be preferable to use slaked lime. A combination of the aforesaid calcium compounds may also be used, if desired.

Table 2 shows the desirable test results of pellets produced from a magnetite concentrate obtained from Chile, using a grate kiln process. The Table indicates the operating conditions and describes the pellets produced. Test No. A refers to the case of 1% bentonite being added as a binder to the starting powder. Test No. B represents the case of 2% slaked lime being added to the starting concentrate to the basicity ($CaO/SiO_2$) of no more than 1. Test No. C represents the case of 3% slaked lime being added to the starting concentrate to the basicity of 1 to 2 (the present invention).

Table 2

| Additive (weight percent) | | Bentonite (1%) | | $Ca(OH)_2$ (2%) | | $Ca(OH)_2$ (3%) | |
|---|---|---|---|---|---|---|---|
| Test No. | | A-1 | A-2 | B-1 | B-2 | C-1 | C-2 |
| Drying condition | | 370°C × 7min | the same as left | the same as left | the same as left | the same as left | the same as left |
| Preheating condition | | 1000°C × 6min | 1050°C × 4.25min | 1050°C × 4.25min | 1100°C × 4.25min | 1050°C × 4.25min | 1100°C × 4.25min |
| Strength of preheated pellet (kg/ltr) | | 45.4 | 53.6 | 11.5 | 16.4 | 19.1 | 29.7 |
| Firing condition | | 1240°C × 30 min | the same as left | the same as left | the same as left | the same as left | the same as left |
| Quality of pellets produced | Total Fe (%) | 67.44 | 67.51 | 67.16 | 67.23 | 66.75 | 66.67 |
| | FeO (%) | 0.89 | 1.14 | 0.81 | 0.90 | 0.56 | 0.84 |
| | Basicity | — | — | 0.72 | 0.69 | 1.21 | 1.20 |
| | Crushing strength (kg/pellet) (Strength of a single pellet) | 243 | 232 | 306 | 340 | 375 | 383 |
| | Porosity (%) | 20.3 | 20.6 | 21.5 | 22.55 | 21.3 | 20.9 |
| | Percent reduction (%) | 55.4 | 56.0 | 78.0 | 77.3 | 76.5 | 78.3 |
| | Strength after reduction (kg/pellet) | 56.9 | 48.8 | 25.3 | 32.3 | 89.6 | 123.2 |
| | Swelling index (%) | 11.8 | 14.0 | 28.4 | 30.1 | 13.9 | 14.2 |
| | Double or concentric structure | present | present | none | none | none | none |

FIGS. 3(*c*) and (*d*) are photographs depicting the cross-sectional structures of pellets produced according to the Test No. A-2, in which bentonite was added, and the preheating condition was set at 1050°C for 4.25 min. In Test No. C-1, slaked lime was added, and the preheating condition was set at 1050°C for 4.25 min. FIGS. 3(*e*) and (*f*) are photographs of the appearance of the pellets after reduction, which have been produced according to Test No. B-2, in which slaked lime was added to a basicity of starting material of 0.69 and 1.20, respectively.

The test results show that pellets produced according to Test No. C i.e., according to the process of the present invention, exhibit particularly excellent and improved characteristics, such as improved strength, improved percent reduction, and strength after reduction. Particularly, the pellets of No. C-1 give evident differences as compared with those of No. A-2, under the same preheating conditions. On the other hand, as shown in the photograph in FIG. 3(*c*), the pellets of No. A exhibit the aforesaid double structure. When the process according to the present invention is used, no double structure is observed, as shown in FIG. 3(*d*), which shows a quite uniform structure. In Test No. A, as well, pellets of No. A-1 are superior in strength after reduction and swelling index as compared with those of No. A-2. Those differences are due only to the different preheating conditions, proving that the desired effects are due to preheating at a relatively low temperature for a long period of time. In comparison to pellets produced according to the present invention, the pellets of Test No. B, pellets of No. B exhibit improvements in crush strength, percent reduction and double structure, although those pellets are much inferior in strength after reduction to those of the present invention. This is because, as is evident from a comparison of FIG. 3(*e*) (No. B) with FIG. 3(*f*), which show the appearance of the pellets after reduction, cracks are developed in the pellets due to abnormal swelling in the course of reduction.

It was also found that the basicity of the pellet material has a close relationship with those drawbacks.

FIG. 4 shows the relationship between basicity ($CaO/SiO_2$) of the material, and the swelling index, in which the swelling index of the pellets exhibits a sharp increase at a basicity of below 1, and reduced quality. On the other hand, if the basicity is more than 5, the additional calcium compounds provide no further desirable effect. In practical application, a basicity of 1 to 2 is most preferable. Accordingly, it is imperative that the basicity of 1 to 5, preferably 1 to 2 be selected.

Table 3 shows the widely accepted specification of the quality of pellets for a blast furnace and further shows the improvements of the pellets produced according to the present invention. As is clear from the results given in Table 2, the pellets of No. A, to which bentonite has not been added do not satisfy the specified crushing strength, percent reduction and strength after reduction, while the pellets of No. B, to which slaked lime has been added, but in which the basicity is below 1 fail to meet the specified strength-after-reduction and swelling index, respectively. In contrast thereto, the pellets of No. C produced according to the present invention, all meet the requirements specified therein.

TABLE 3

| Quality of pellets produced | Specified Value |
|---|---|
| Crush strength | no less than 250 kg |
| Rotating strength - 1 mm | no more than 4% |
| JIS percent reduction | no less than 60% |
| Crush strength after reduction | no less than 50 kg |
| Swelling index | no more than 16% |

Meanwhile, according to the present invention, the pellets of a desired quality may be obtained without specifically defining the preheating conditions, as far as the temperature of the preheating falls within the range of 950° to 1000°C. However, for desired advantages in the actual production, it is imperative that the temperatures during preheating range from 1000° to 1150°C, which is higher than the ordinary preheating temperature. The time required for preheating should be held to 3 to 10 minutes. Most preferably, the preheating temperature should be set within the range of 1050° to 1100°C and the time for preheating within the range of 4 to 6 minutes.

The aforesaid ranges will improve the production efficiency of the pellets to a great extent, and in addition, the high temperature exhaust gas (1000° to 1150°C) from the firing step may be effectively recycled and utilized.

The drying step prior to the preheating should be such that, as in the conventional process, the temperature range is from 300° to 450°C, and the time for drying be within the range of from 4 to 10 minutes. If dried at a temperature of below 300°C, excessively long time periods will be required, while temperatures of over 450°C will result in the rapid evaporation of water, thus failing to achieve the intended effects. If the time for drying is less than 4 minutes, there will be obtained insufficient drying conditions, while the use of time periods of over 10 minutes gives no advantage, and thus is not desirable from the viewpoint of production.

The firing step after the preheating should be such that, as in the conventional process, the temperature range will be within 1200° to 1300°C, and the time for firing will be within the range of from 10 to 40 minutes. If fired at a temperature of below 1200°C, overfiring can occur. On the other hand, periods of firing of no more than 10 minutes will provide no further improvements in pellet strength, while periods of no less than 40 minutes will lead to reduced strengths and reduced production efficiency. As a result, it is preferable that the temperature be within the range of from 1200° to 1350°C and the time be within the range of from 10 to 40 minutes.

As is apparent from the foregoing description, the process according to the present invention will prevent the so-called double or concentric structure problems and will improve the quality of pellets to a great extent, with the accompanying great improvements in the productivity and advantageous utilization of exhaust gases, thus presenting industrial and technical advantages which are highly evaluated.

It will be understood that the above description is merely illustrative of preferred embodiments of the invention. Additional modifications and improvements utilizing the discoveries of the present invention can be readily anticipated by those skilled in the art from the present disclosure, and such modifications and improvements may fairly be presumed to be within the scope and purview of the invention as defined by the claims that follow.

What is claimed as new and intended to be covered by Letters Patent is:

1. A process for producing iron-ore oxidized pellets from magnetite concentrate, comprising the steps of:

adding to said magnetite concentrate at least one calcium compound selected from the group consisting of slaked lime, quicklime, limestone and mixtures thereof, to basicity of 1 to 5;

granulating the resulting mixture;

drying the same;

preheating the granules thus prepared at a temperature of 1000° to 1150°C for 3 to 10 minutes; and firing the thus preheated granules.

2. The process for producing iron-ore oxidized pellets as defined in claim 1, wherein said preheating is carried out at a temperature of 1050° to 1100°C for 4 to 6 minutes.

3. The process for producing iron-ore oxidized pellets as defined in claim 2, wherein slaked lime is added as a calcium compound to a magnetite concentrate to a basicity of 1 to 2.

4. The process for producing iron-ore oxidized pellets, as defined in claim 1, wherein said calcium compound is quicklime.

5. The process for producing iron-ore oxidized pellets, as defined in claim 1, wherein said mixture is granulated to a grain size of 8 to 20 mm in diameter.

6. Iron-ore oxidized pellets produced by the process of claim 1.

* * * * *